US011670277B1

(12) United States Patent
Kim et al.

(10) Patent No.: US 11,670,277 B1
(45) Date of Patent: Jun. 6, 2023

(54) SYSTEM AND METHOD FOR PROVIDING FREQUENCY DEPENDENT DYNAMIC LEAKAGE FOR A FEED FORWARD ACTIVE NOISE CANCELLATION (ANC)

(71) Applicant: Harman International Industries, Incorporated, Stamford, CT (US)

(72) Inventors: Geon-Seok Kim, Novi, MI (US); Rajeshkumar Venugopal, Stamford, CT (US); Tao Feng, Novi, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/538,045

(22) Filed: Nov. 30, 2021

(51) Int. Cl.
*G10K 11/178* (2006.01)

(52) U.S. Cl.
CPC .... *G10K 11/1785* (2018.01); *G10K 11/17823* (2018.01); *G10K 11/17873* (2018.01); *G10K 2210/1282* (2013.01)

(58) Field of Classification Search
CPC ..... G10K 11/17823; G10K 11/17815; G10K 11/178; G10K 11/17833; G10K 11/7835; G10K 2210/3055; H03G 7/002; H03G 7/007; H03H 21/0027; H04R 3/007
See application file for complete search history.

(56) References Cited

FOREIGN PATENT DOCUMENTS

| | | | | |
|---|---|---|---|---|
| CN | 111833841 | A | 10/2020 | |
| GB | 2582905 | A | 10/2020 | |
| WO | 2018097946 | A1 | 5/2018 | |
| WO | 2019210983 | A1 | 11/2019 | |
| WO | WO-2019210983 | A1 * | 11/2019 | ..... G10K 11/17823 |

OTHER PUBLICATIONS

European Search Report dated Mar. 30, 2023 for European Application No. 22210067.9, 8 pgs.

* cited by examiner

*Primary Examiner* — Kile O Blair
(74) *Attorney, Agent, or Firm* — Brooks Kushman P.C.

(57) ABSTRACT

In at least one embodiment, a system for providing a frequency dependent dynamic leakage for noise cancellation is provided. The system includes a noise cancellation controller and a current limiter. The noise cancellation controller is programmed to perform noise cancellation in a vehicle based on a limited input signal. The current limiter is programmed to receive a reference signal from one of an accelerometer or a loudspeaker and to convert the reference signal from a time domain and into a frequency domain to limit the reference signal. The current limiter is further programmed to generate the limited input signal in response to limiting the reference signal.

20 Claims, 10 Drawing Sheets

SYSTEM AND METHOD FOR PROVIDING FREQUENCY DEPENDENT DYNAMIC LEAKAGE FOR A FEED FORWARD ACTIVE NOISE CANCELLATION (ANC)

TECHNICAL FIELD

Aspects disclosed herein generally relate to a system and method for providing frequency dependent dynamic leakage (FDDL-X) for a feed forward active noise cancellation (ANC) or road noise cancellation (RNC). These aspects and others will be discussed in more detail below.

BACKGROUND

Active noise control (ANC) systems utilize current limiters to prevent excessive inputs from feed forward sensors. In addition, road noise cancellation (RNC) systems also utilize a limiter for signals that are received from accelerometers and loudspeakers. However, such current limiters operate in a time domain. In addition, feed forward signal frequency contents significantly vary based on vehicle driving conditions. Therefore, the time domain-based limiter may be effective only for very limited occasions. It is impractical to rely on time domain-based limiters to detect the excessive abnormal inputs from various vehicles and the roads that vehicles travel on.

SUMMARY

In at least one embodiment, a system for providing a frequency dependent dynamic leakage for noise cancellation is provided. The system includes a noise cancellation controller and a current limiter. The noise cancellation controller is programmed to perform noise cancellation in a vehicle based on a limited input signal. The current limiter is programmed to receive a reference signal from one of an accelerometer or a loudspeaker and to convert the reference signal from a time domain and into a frequency domain to limit the reference signal. The current limiter is further programmed to generate the limited input signal in response to limiting the reference signal.

In at least another embodiment, a method for providing a frequency dependent dynamic leakage for noise cancellation is provided. The method includes performing noise cancellation in a vehicle, via a noise cancellation controller, based on a limited input signal and receiving, at a current limiter, a reference signal from one of an accelerometer or a loudspeaker. The method further includes converting the reference signal from a time domain and into a frequency domain to limit the reference signal and generating the limited input signal in response to limiting the reference signal.

In at least another embodiment, a computer-program product embodied in a non-transitory computer read-able medium that is programmed for providing a frequency dependent dynamic leakage for noise cancellation is provided. The computer-program product includes instructions for performing noise cancellation in a vehicle, via a noise cancellation controller, based on a limited input signal and receiving, at a current limiter, a reference signal from one of an accelerometer or a loudspeaker. The computer-program product further includes instructions for converting the reference signal from a time domain and into a frequency domain to limit the reference signal and generating the limited input signal in response to limiting the reference signal.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
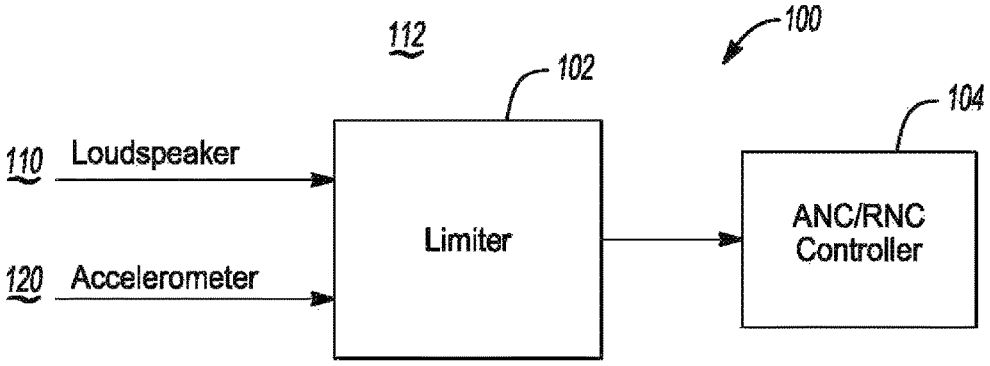
FIG. 1 depicts a system for providing frequency dependent dynamic leakage for a feed forward active noise cancellation (ANC) system in accordance with one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers/devices as disclosed herein and in the attached Appendix may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein. While the various systems, blocks, and/or flow diagrams as noted herein refer to time domain, frequency domain, etc., it is recognized that such systems, blocks, and/or flow diagrams may be implemented in any one or more of the time-domain, frequency domain, etc.

As noted above, time domain-based limiters may be effective only for very limited occasions. However, it may be impractical to rely on time domain-based limiters to detect the excessive abnormal inputs from various roads and vehicles. The disclosed system and method that provides frequency dependent dynamic leakage ("FDDL-X") as disclosed herein generally utilizes a frequency domain spectrum of feed forward signals. A threshold may be defined for each feed forward signal. The threshold may be precisely defined in the frequency domain based on the signals acquired during normal vehicle operating conditions. A current limiter of the disclosed system continuously monitors input signals in a frequency domain. When such input signals exceed their corresponding thresholds, the disclosed system may calculate the feed forward dynamic leakage and multiply the feed forward dynamic leakage to corresponding feed forward signal gains.

In general, a Multi-Input-Multi-Output (MIMO) ANC system requires a balanced input for stable operation. However, the current limiter operates for each signal, which can cause an unbalanced input when high inputs are present only in a few channels. The disclosed system (e.g., see FIGS. 1 and 3) and corresponding current limiter as set forth herein provides an energy balance of multiple inputs by equalizing the input signals. The equalized gain is calculated by a moving average technique at a beginning of a tuning process. When the current limiter that incorporates the FDDL-X (e.g., monitoring of input signals in the frequency domain) detects abnormal inputs, the current limiter multiplies the same leakage to each channel to maintain the balanced inputs. The current limiter prevents the system from exhibiting a boosting condition due to unbalanced input. In the MIMO ANC system, anti-noise signals are calculated based on an accelerometer signal and an adaptive filter. If the accelerometer input signals are not balanced, a least mean square (LMS) algorithm tends to weight more on high input signals than low input signals. This may result in noise boosting at certain frequency ranges. Additionally, when vehicle driving conditions change suddenly, for example, the vehicle is driving on a dirt road and encounters a speed bump, the input signal changes dramatically. In this case, the adaptive filter may not immediately change its coefficient to produce an optimum anti-noise signal. This condition causes noise boosting.

FIG. 1 depicts a system 100 for providing the FDDL-X for a feed forward noise cancellation system in accordance with one embodiment. The system 100 generally includes a current limiter 102 and an active noise cancellation (ANC) or a road noise cancellation (RNC) controller 104 (hereafter "noise cancellation controller 104"). The noise cancellation controller 104 is operably coupled to the current limiter 102 and performs ANC functionality for a vehicle 112. The current limiter 102 is generally configured to receive reference signals from one or more loudspeakers ("loudspeakers") 110 positioned in the vehicle 112. In addition, the current limiter 102 is also configured to receive reference signals from one or more accelerometers ("accelerometers") 120 positioned in the vehicle 112. The current limiter 102 is also configured to monitor an amplitude of the accelerometer signal and the loudspeaker signal and limit excessive input (or excessive amplitude). The noise cancellation controller 104 generally collects information from the loudspeakers 110 and the accelerometers 120.

Generally, the noise cancellation controller 104 is configured to detect disturbances and undesired noise and transmit signals indicative of the undesired noise to the noise cancellation controller 104. In one example, the accelerometers 120 may be mounted exterior to the vehicle may provide information indicative of road noise. The error microphones 122 may be positioned in an interior of the vehicle 112 may provide information indicative of road noise or engine noise present in the interior of the vehicle. In turn, the noise cancellation controller 104 may transmit sound that is out of phase via the one or more loudspeakers 110 in the vehicle 112. The out of phase audio transmitted by the loudspeakers 110 may cancel the disturbing noise present in the interior of the vehicle 112.

Figure 2:
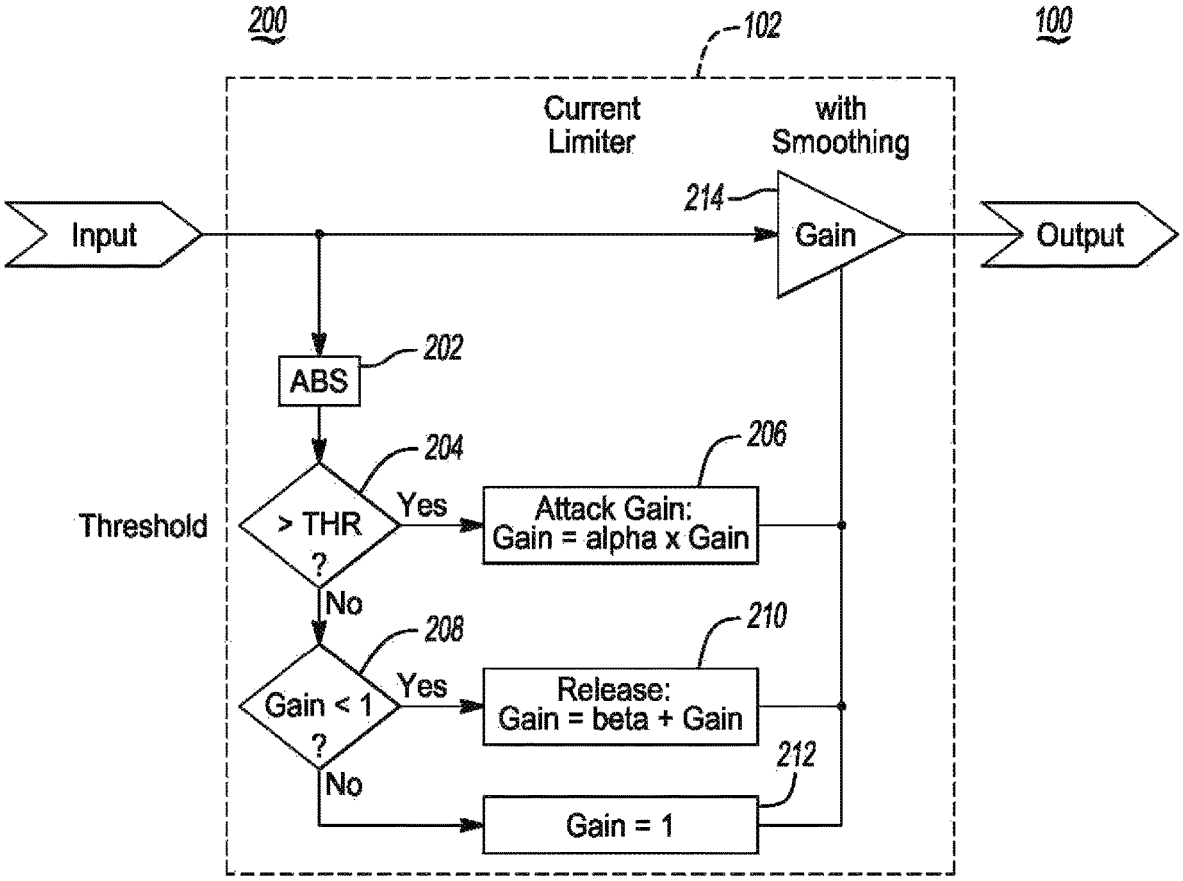
FIG. 2 depicts one example of a block diagram that is executed by a current limiter.

FIG. 2 depicts one example of a block diagram 200 that is executed by the current limiter 102. The current limiter 102 generally includes a first block 202, a first comparison block 204, a second block 206, a second comparison block 208, a third block 210, a fourth block 212, and a fifth block 214. It is recognized that the current limiter 102 includes any number of processors or controllers that execute the first block 202, the first comparison block 204, the second block 206, the second comparison block 208, the third block 210, the fourth block 212, and the first block 214. The current limiter 102 receives an input signal (e.g., the loudspeaker signal or the accelerometer signal) and provides the same to the first block 202. The first block 202 takes an absolute value of the incoming signal to provide a gain for the incoming signal.

The first comparison block 204 compares the gain output of the first block 202 to a predetermined threshold (e.g., the predetermined threshold may be, for example, 0.71 (e.g., or for a −3 dB full scale) in the event the incoming input signal is a loudspeaker signal, or the predetermined threshold may be, for example, 0.5 (e.g., or for a −6 dB full scale) in the event the incoming input signal is an accelerometer signal). If the gain output of the first block 202 is greater than the threshold, then the second block 206 is executed to provide an attack gain. For example, in the second block 206, a new gain value (or attack gain value) is calculated based on alpha*Gain (e.g., the gain of the output from the first block 202). In general, the value for alpha may be set to, for example, 0.9 in the event the incoming input signal is set to the loudspeaker signal or to the accelerometer signal. If the gain output of the first block 202 is less than the threshold, then the second comparison block 208 is executed.

If the gain output of the first comparison block 204 is greater than one, the third block 210 is executed. In the third block 210, a new gain value (or release gain value) is calculated based on beta*Gain (e.g., the gain of the output from the first block 202). In general, the value for beta may be set to 0.1 in the event the incoming input signal is set to the loudspeaker signal or to the accelerometer signal. If the gain output is less than one, then the fourth block 212 is executed where the gain is set to one. The fifth block 214 is a multiplier and multiples the attack gain from the block 206 to the gain of the incoming input signal or multiples the release gain from the block 210 to the gain of the incoming input signal or alternatively, multiplies the unity gain from the block 212 to the gain of the incoming input signal.

Figure 3:
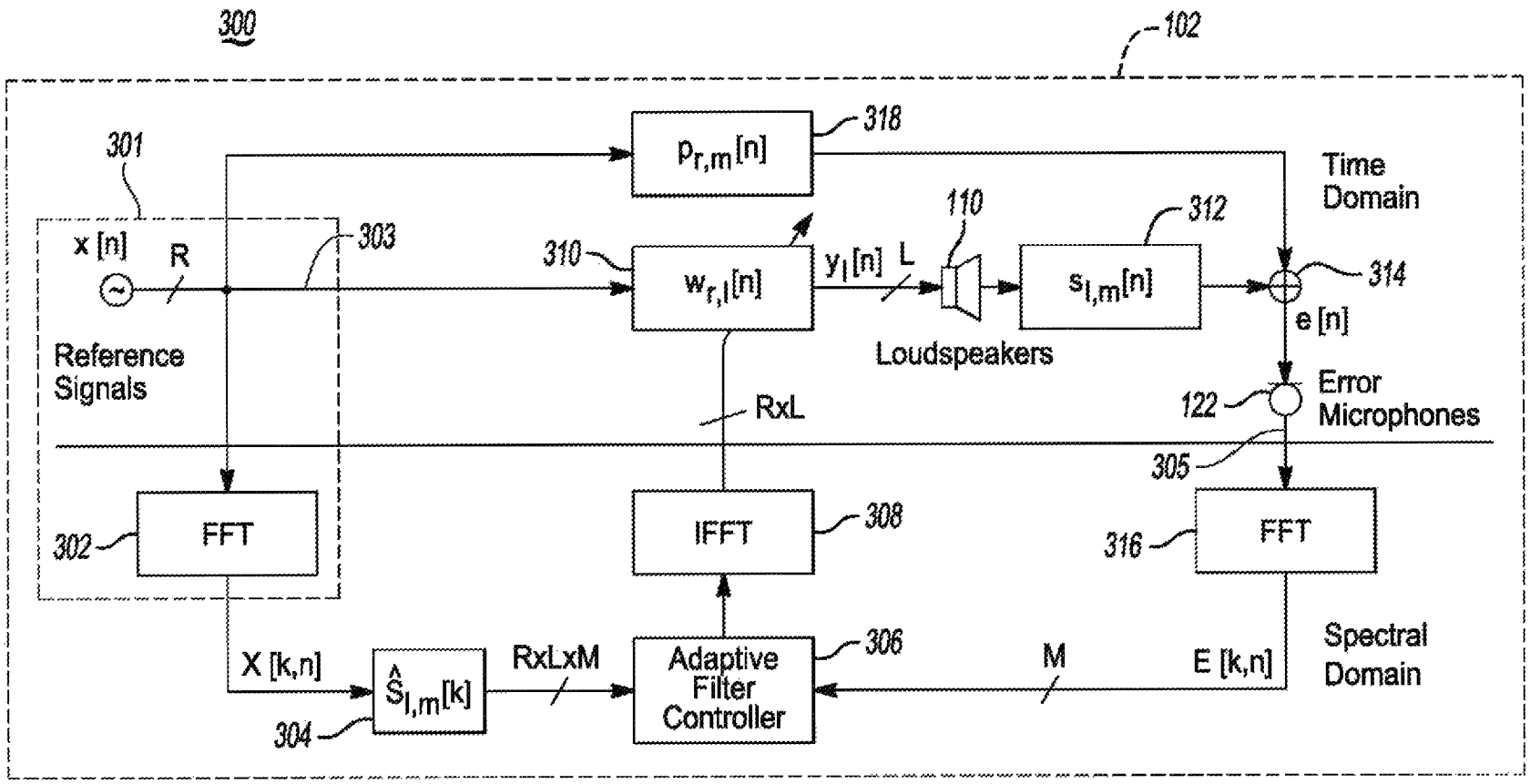
FIG. 3 depicts another block diagram of a portion of the current limiter in accordance with one embodiment.

FIG. 3 is a schematic block diagram illustrating an example of a road noise cancellation (RNC) system 300. The RNC system 300 generally includes one or more reference sensors 301 that pick up (or receive) a reference signal 303. The reference sensor 301 may be an accelerometer or a microphone (e.g., microphone that captures the loudspeaker signal). The reference signal 303 (e.g., x(n)) may be filtered with an estimated secondary path ŝ (z) 304, after the reference signal 303 is converted into a frequency domain, the secondary path ŝ (z) 304 estimates the transfer function between an error microphone 122 and the anti-noise speaker 110 (e.g., the loudspeaker 110 noted in FIG. 1). The error microphone 122 generally provides an error microphone signal 305 (e.g., $e_m(n)$) that is based on a loudspeaker output signal 312 and the reference signal 310 as such a signal passes on a primary path 312. An adder 314 sums the loudspeaker output signal 312 to the to the reference signal 310 on the primary path 312.

Generally, road noise originates from an interaction of a road surface and a wheel where such noise is transferred to the error microphone 122 in accordance with a primary path P(z). The primary path P(z) represents a transfer function between the actual noise source and the error microphone 122. In order to reduce the computational cost for RNC system 300, a time-frequency domain filtered-x least mean square (FxLMS) algorithm as executed by the noise cancellation controller 104, which uses Fast Fourier Transform (FFT) blocks 302, 316 to transfer the time domain reference signal, x(k,n) 303 and the error microphone signal 305, E(k,n) into a frequency domain. An adaptive filter controller 306 generates filter coefficients in the frequency domain based on the reference signal and the error microphone signal in the frequency domain. An Inverse Fast Fourier Transformer (IFFT) block 308 transfers the frequency domain-based coefficients for an adaptive filter 310 (e.g., W-filter) into the time domain.

In general, RNC systems may be based on a FxLMS algorithm that is in the time and frequency domain. The noise cancellation controller 104 executes the FxLMS algorithm and processes the reference signal 303 and error microphone signal 305 in the frequency domain based on FFT blocks 302 and 316. As noted above, the adaptive filter controller 306 generates coefficients for the adaptive filter 310, however such coefficients are in the frequency domain. If the system 300 directly applies the coefficients only in the frequency domain, this aspect may generate unwanted delay and affect RNC system performance. To avoid the delay caused by frequency domain W filter (or frequency domain coefficients used by a W-filter), the IFFT block 308 transfers the frequency domain W filter (or coefficients) into the time domain prior to being received at the controller filter 310. The adaptive filter 310 may then update current filter coefficients with the received filter coefficients. The adaptive filter 310 provides the speaker output y(n) while updating W-filter coefficients. The anti-noise signal ideally has a waveform such that when the anti-noise signal is played through the loudspeaker 110, the anti-noise signal generated by speaker output y(n) and that is filtered by secondary path S(z), is provided near an occupant's ears and the microphone. The anti-noise signal may be substantially opposite in phase and the same in magnitude to that of road noise audible to the occupant of the vehicle cabin.

Figure 4:
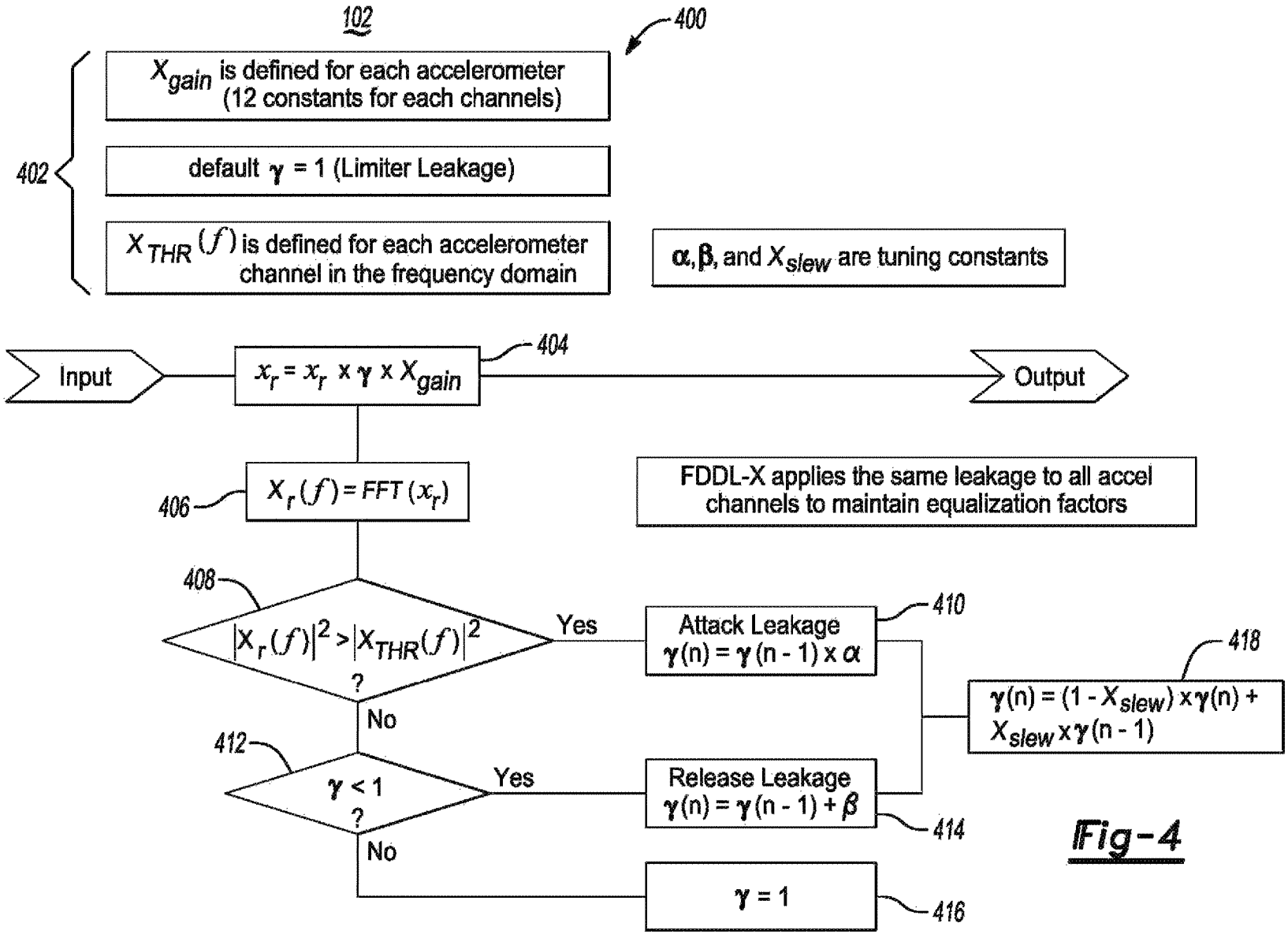
FIG. 4 depicts a method for providing frequency dependent dynamic leakage for a feed forward active noise cancellation (ANC) system in accordance with one embodiment.

FIG. 4 depicts a method 400 for providing frequency dependent dynamic leakage for a feed forward active noise cancellation (ANC) system in accordance with one embodiment. At 402, various variables are defined such as (i) X_gain (or gain constant) is defined for each accelerometer 120 such as, for example, 12 constants for each channel, (ii) default γ=1 (Limiter leakage or limiter leakage constant)), (iii) $x_{THR}(f)$ (or threshold reference gain) is defined for each accelerometer channel in the frequency domain, and (iv) α, β, and $x_{slew}$ are tuning constants. It is recognized that the current limiter 102 includes one or more processors for executing the operations noted below.

In operation 404, the current limiter 102 calculates a modified the reference signal, $x_r$ as follows: $x_r = x_r \times \gamma \times X_{gain}$. For example, the reference signal is modified based on the gain constant and the limiter leakage constant. It is recognized that the reference signal $x_r$ generally corresponds to a reference signal, such as for example, an accelerometer signal or a loudspeaker signal.

In operation 406, the current limiter 102 transforms the modified reference signal $x_r$ from the time domain into a frequency domain (e.g., $X_r(f)$).

In operation 408, the current limiter 102 compares the modified reference signal in the frequency domain ($|X_r(f)|^2$) to a threshold reference gain $|X_{THR}(f)|^2$. If the modified reference signal $|X_r(f)|^2$ is greater than a threshold reference gain $|X_{THR}(f)|^2$, then the method 400 proceeds to operation 410. If not, then method 400 proceeds to operation 412.

In operation 410, the current limiter 102 applies an attack leakage that is generally defined by $\gamma(n)=\gamma(n-1)\times\alpha$ to limit the gain of the reference signal, where n corresponds to an iteration. In this instance, the current limiter 102 may be more aggressive in limiting the overall gain of the reference signal by increasing an overall amount of time in which the current limiter 102 takes in limiting the gain of the incoming signal.

In operation 412, the current limiter 102 compares the limiter leakage γ to one. If the limiter leakage γ is greater than one, then the method 400 moves to operation 414. If not, the method 400 moves to operation 416.

In operation 414, the current limiter 102 applies a release leakage that is defined by $\gamma(n)=\gamma(n-1)+\beta$, where n corresponds to an iteration. In this instance, the current limiter 102 may be less aggressive in reducing the overall gain of the incoming signal (or reference signal) in comparison to the attack leakage. For example, the currently limiter 102 may respond to reduce the gain at a time that is less than that employed when the attack leakage is applied.

In operation 416, the currently limiter 102 sets γ to one.

In operation 418, the current limiter 102 applies γ(n) (e.g., either the attack leakage or the release leakage) into the following equation $\gamma(n)=(1-X_{slew})\times\gamma(n)+X_{slew}*\gamma(n-1)$ in which $X_{slew}$ serves as a smoothing factor.

Figure 5:
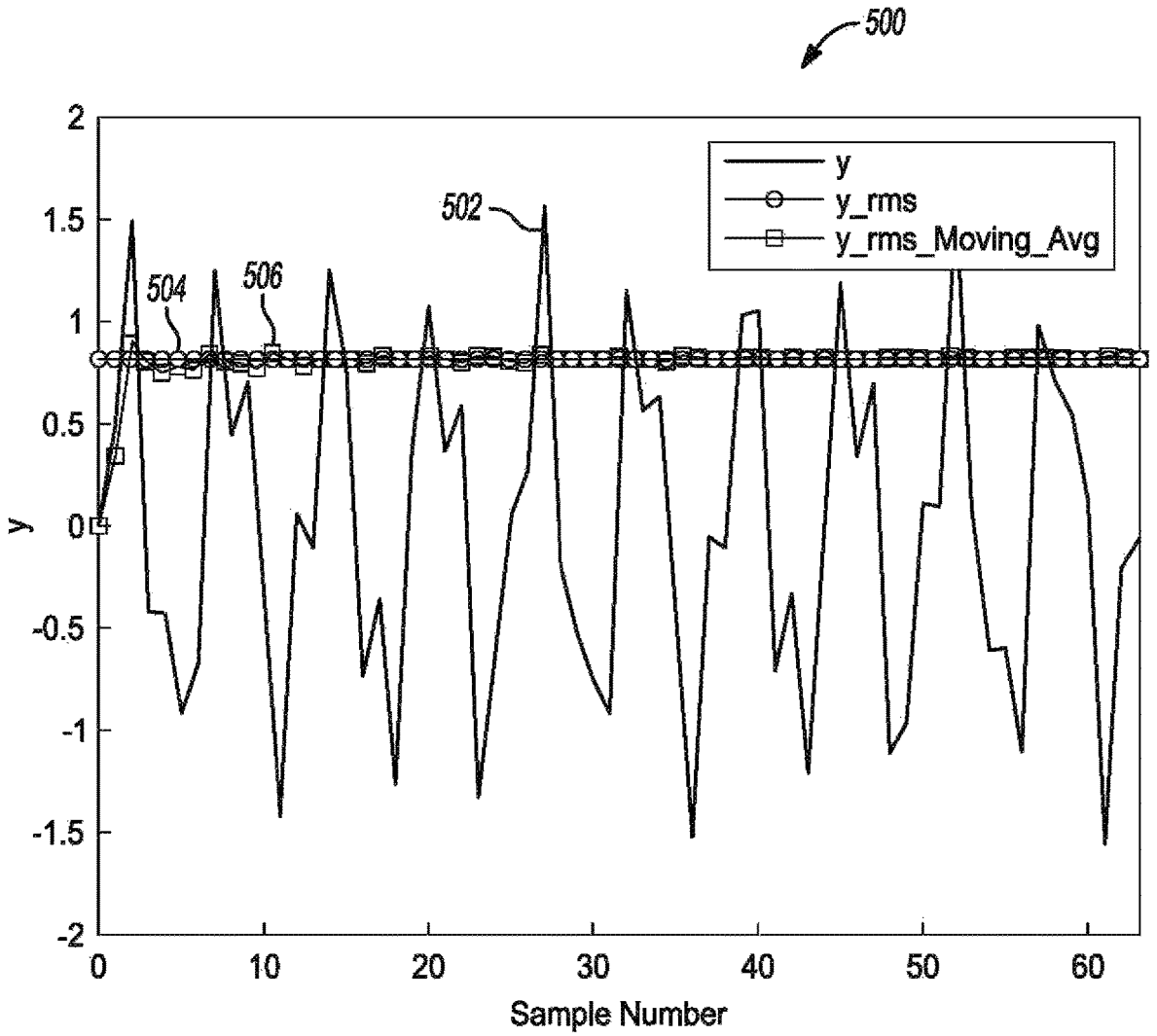
FIG. 5 depicts one example of an equalization plot in accordance with one embodiment.

FIG. 5 depicts one example of an equalization plot 500 in accordance with one embodiment. The plot 500 illustrates a first waveform 502 that corresponds to the reference signal (or incoming input signal (e.g., loudspeaker signal or accelerometer signal. The plot 500 further illustrates a second waveform 504 which corresponds to an average of the first waveform 502 as calculated based on an off-line average computation. Third waveform 506 corresponds to an average of the first waveform 503 as calculated in accordance with a moving average technique. To improve the stability of the reference signal and to avoid being affected by noise, a move averaging (MA) method is applied in waveform 504. The moving average technique or method smooths unwanted high frequency noise to improve the signal-tonoise ratio. Compared with traditional normalization method as exhibited by waveform 502, the waveform 506 generally provides better performance and faster stability).

Figure 6:
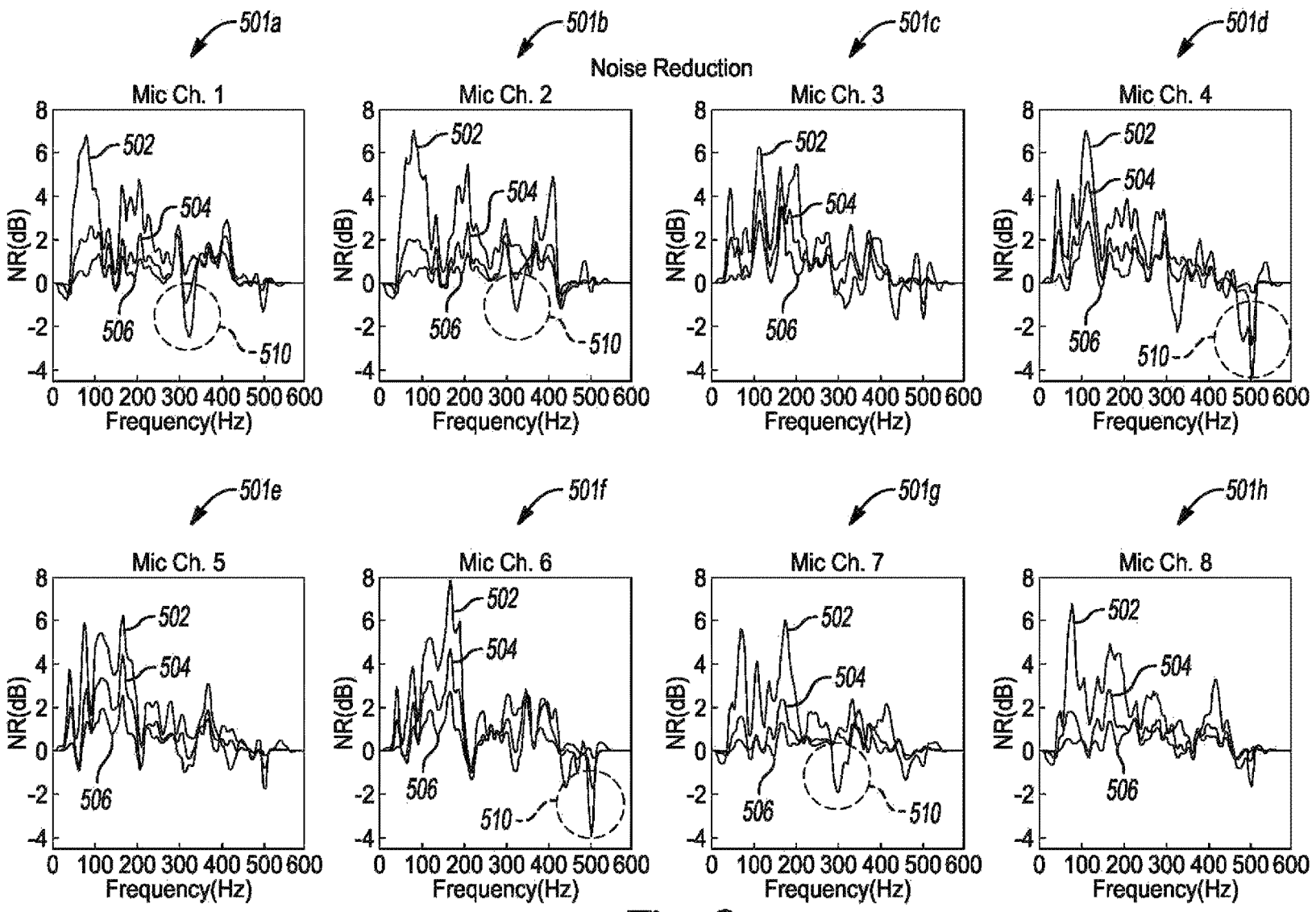
FIG. 6 depicts various plots exhibit a comparison of performance characteristics of a current limiter that implements the block diagram as set forth in FIG. 2 with a current limiter that implements the method as set forth in FIG. 4 in accordance with one embodiment.

FIG. 6 depicts various plots 501*a*-501*h* that exhibit a comparison of performance characteristics of the current limiter 102 that implements the block diagram 200 of the current limiter 102 as set forth in FIG. 2 relative to the method 400 of the current limiter 102 as set forth in FIG. 4 in accordance with one embodiment. Each of the plots 501*a*-500*h* generally correspond to an output of the current limiter for a total of eight channels (e.g., eight output channels provided by the current limiter 102). Each plot 501*a*-501*h* includes a first waveform 502, a second waveform 504, and a third waveform 506. The first waveform 502 generally corresponds to an output provided by the current limiter 102 in which equalization is not performed (e.g., there is no attack leakage or release leakage being applied). The second waveform 504 generally corresponds to an output provided by the current limiter 102 that implements the block diagram 200 of the current limiter 102 as set forth in FIG. 2. The third waveform 506 generally corresponds to an output provided by the current limiter 102 that implements the method 400 of FIG. 4. As shown for each plot 501*a*-501*h*, the outputs of the third waveform 506 exhibits improved noise reduction than the outputs on the first and second waveforms 502, 504. In addition, as exhibited on the second waveforms 506 for the plots 501*d*, 501*f*, and 501*g*; boosting conditions are generally shown at 510 and are associated with the current limiter 102 that incorporate the block diagram 200 of the current limiter 102 as set forth in FIG. 2.

Figure 7A:
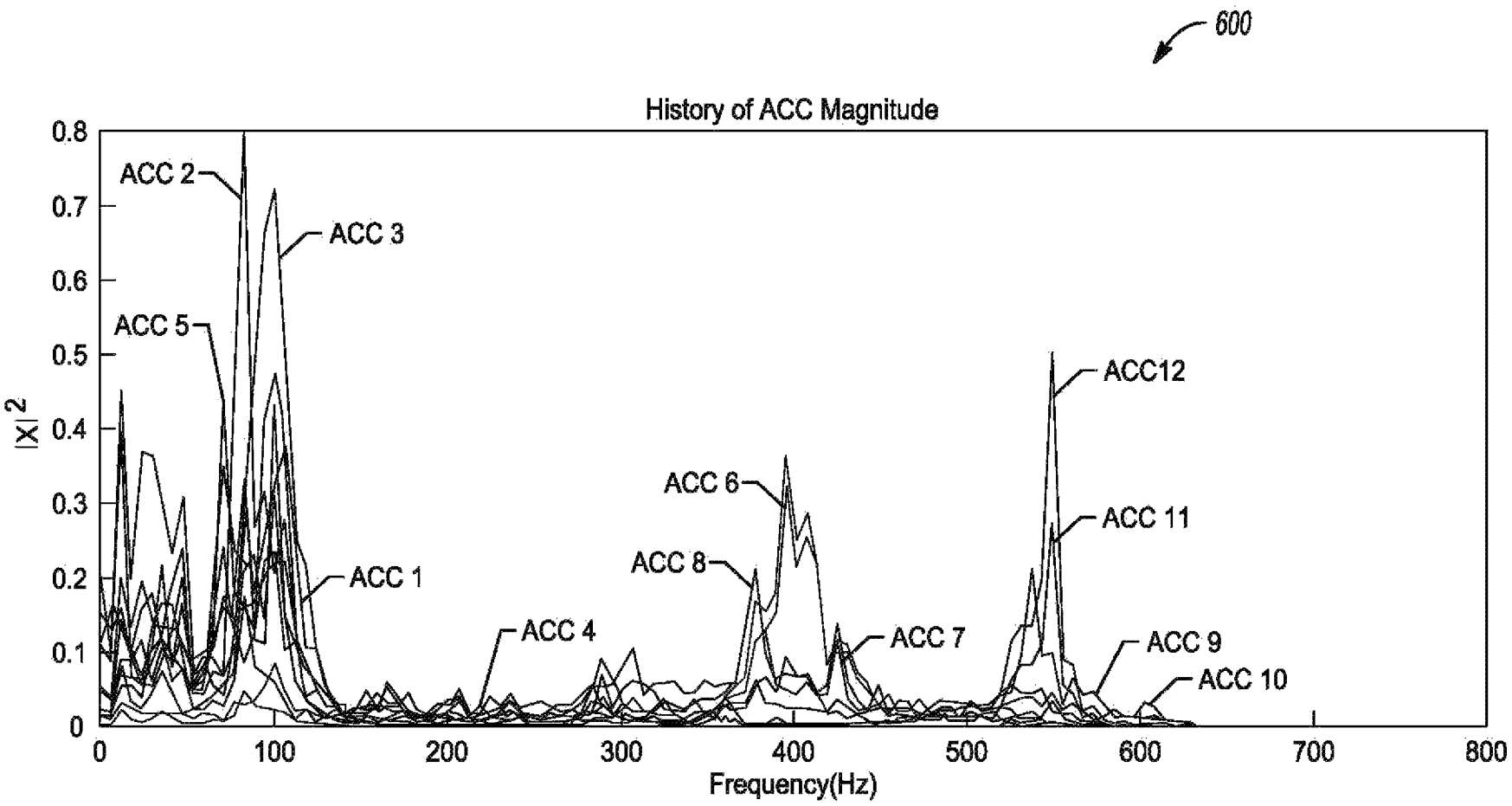
FIGS. 7A and 7B depict additional plots based on aspects of the system and current limiter as shown in connection with FIGS. 2 and 5 in accordance with one embodiment.
Figure 7B:
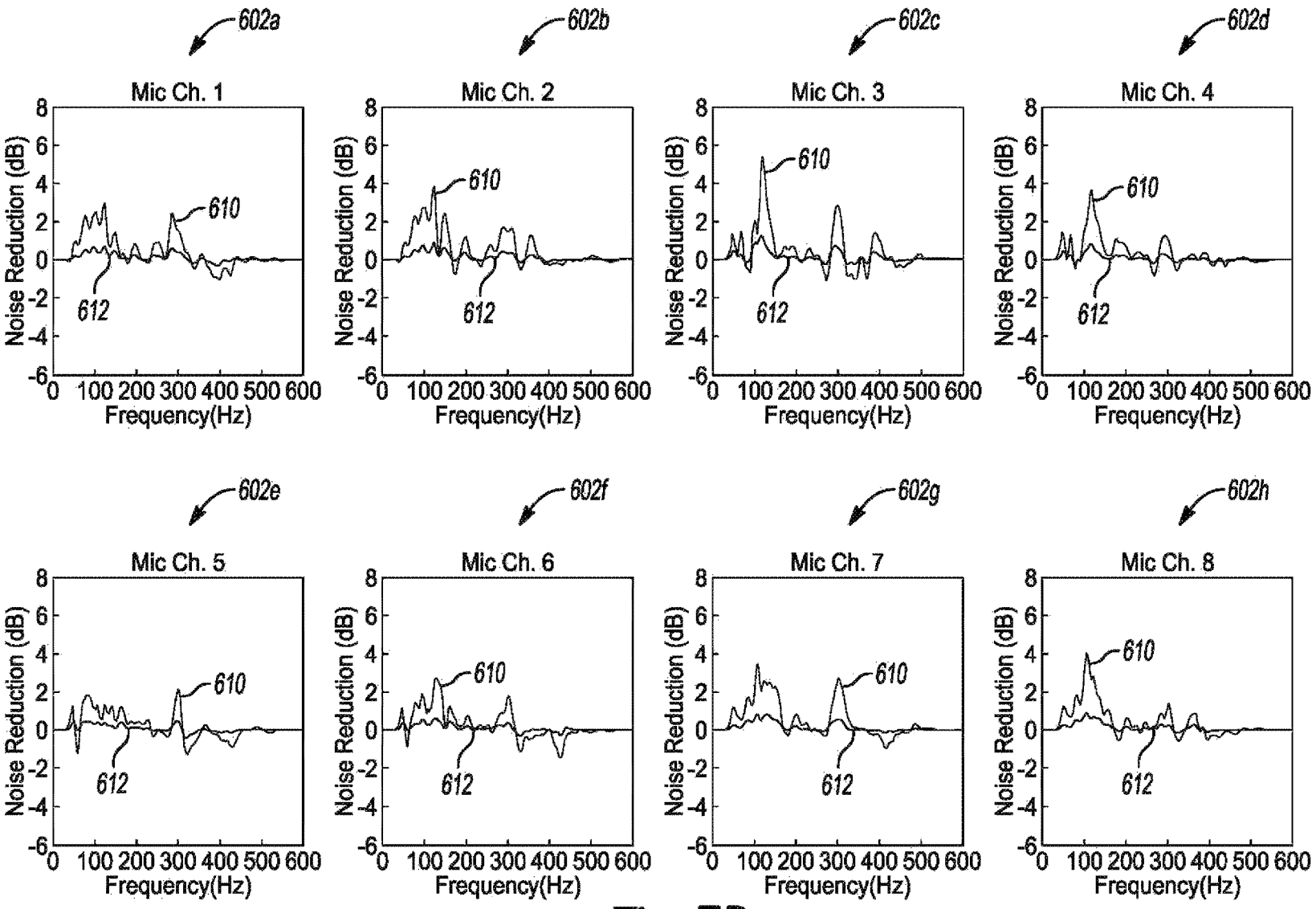

FIG. 7A depicts a plot 600 that is based on aspects of the current limiter 102 that performs the method of FIG. 5 in accordance with one embodiment. Plot 600 generally depicts a plurality of outputs provided by the current limiter 102 for various accelerometer outputs. The plot 600 corresponds to an example of a peak-hold accelerometer spectrum as the vehicle drives on various surfaces. Values as exhibited in the plot 600 may be used to set an accelerometer input threshold, $X_{THR}$ (see operation 408 in FIG. 4 for reference). FIG. 7B depicts plots 602*a*-602*h* that are also based on aspects of the current limiter 102 that perform the method 500 of FIG. 5 in accordance with one embodiment. Each plot 602*a*-600*h* includes a first waveform 610 and a second waveform 612. The plots 602*a*-602*h* depicts a noise reduction in a time period that ranges from 19 seconds to 34 seconds. The first waveform 610 generally corresponds to an output provided by the current limiter 102 in which equalization is not performed (e.g., there is no attack leakage or release leakage being applied). The second waveform 612 generally corresponds to an output provided by the current limiter 102 that implements the method 500 of FIG. 4. As shown, the second waveform 612 shows no boosting under extreme driving condition. Additionally, the second waveform 612 effectively suppresses high frequency boosting which is denoted as a negative reduction (e.g., see 510 in connection with plots 500*d*, 500*g*, and 500*h*).

Figure 8:
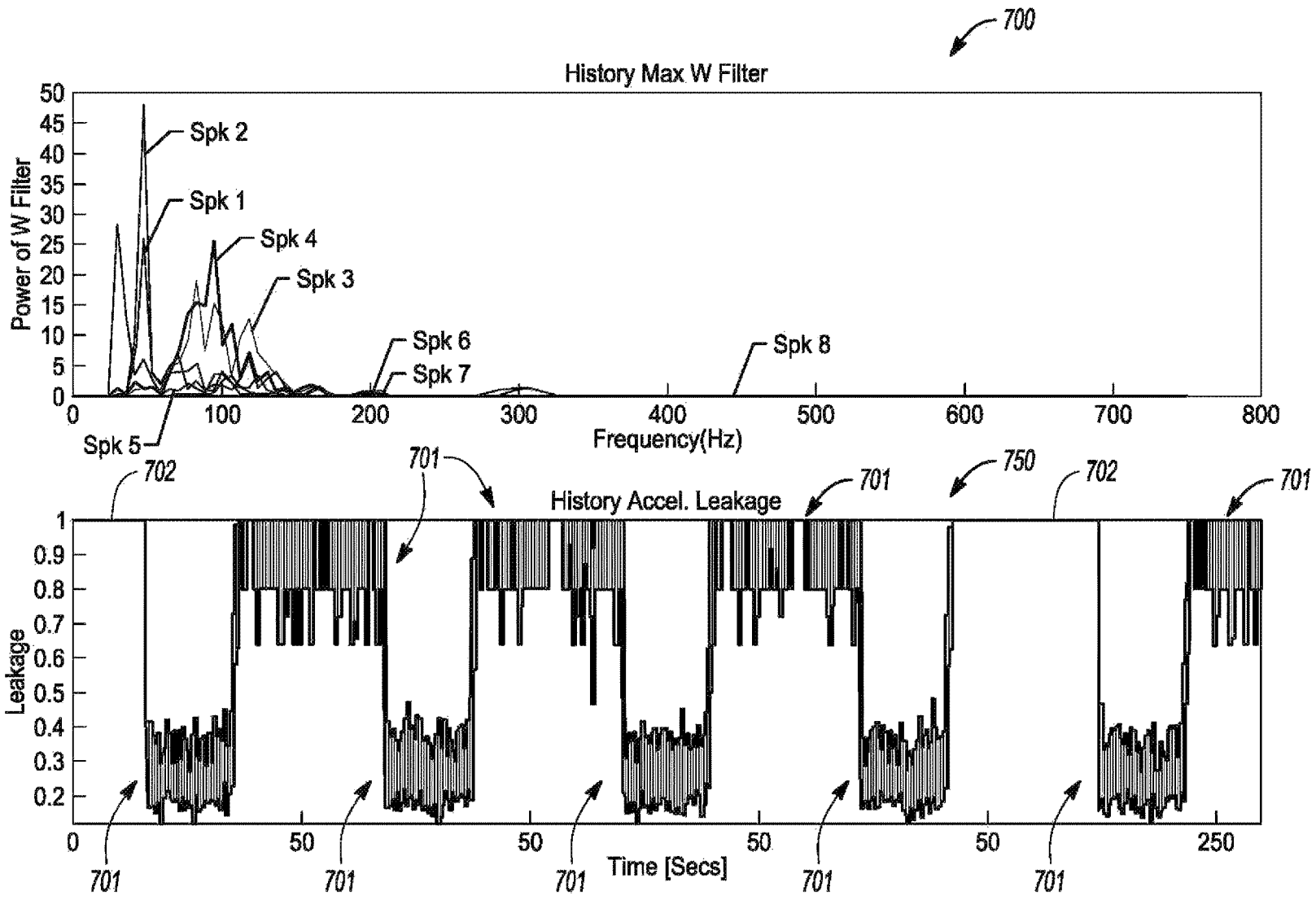
FIG. 8 depicts a first plot corresponding to a history maximum (max) filter and a second plot corresponding to a history of accelerometer leakage in accordance with one embodiment.

FIG. 8 depicts a first plot 700 corresponding to a history maximum (max) filter and a second plot 750 corresponding to a history of accelerometer leakage in accordance with one embodiment. The second plot 750 generally exhibits a monitoring of accelerometer leakage over time. When the vehicle 112 drives on an uneven road or hits a speed bumper, the system 100 when employing the method 400 works to maintain RNC system stability. On a flat road surface, the accelerometer leakage is close to 1 (see generally at 702) which aids to maintain RNC performance. If the vehicle 112 runs on an uneven road surface, accelerometer leakage is below 0.5 (see generally at 701). In this instance, the current limiter 102, when executing the method 400, works to limit RNC boosting.

Figure 9:
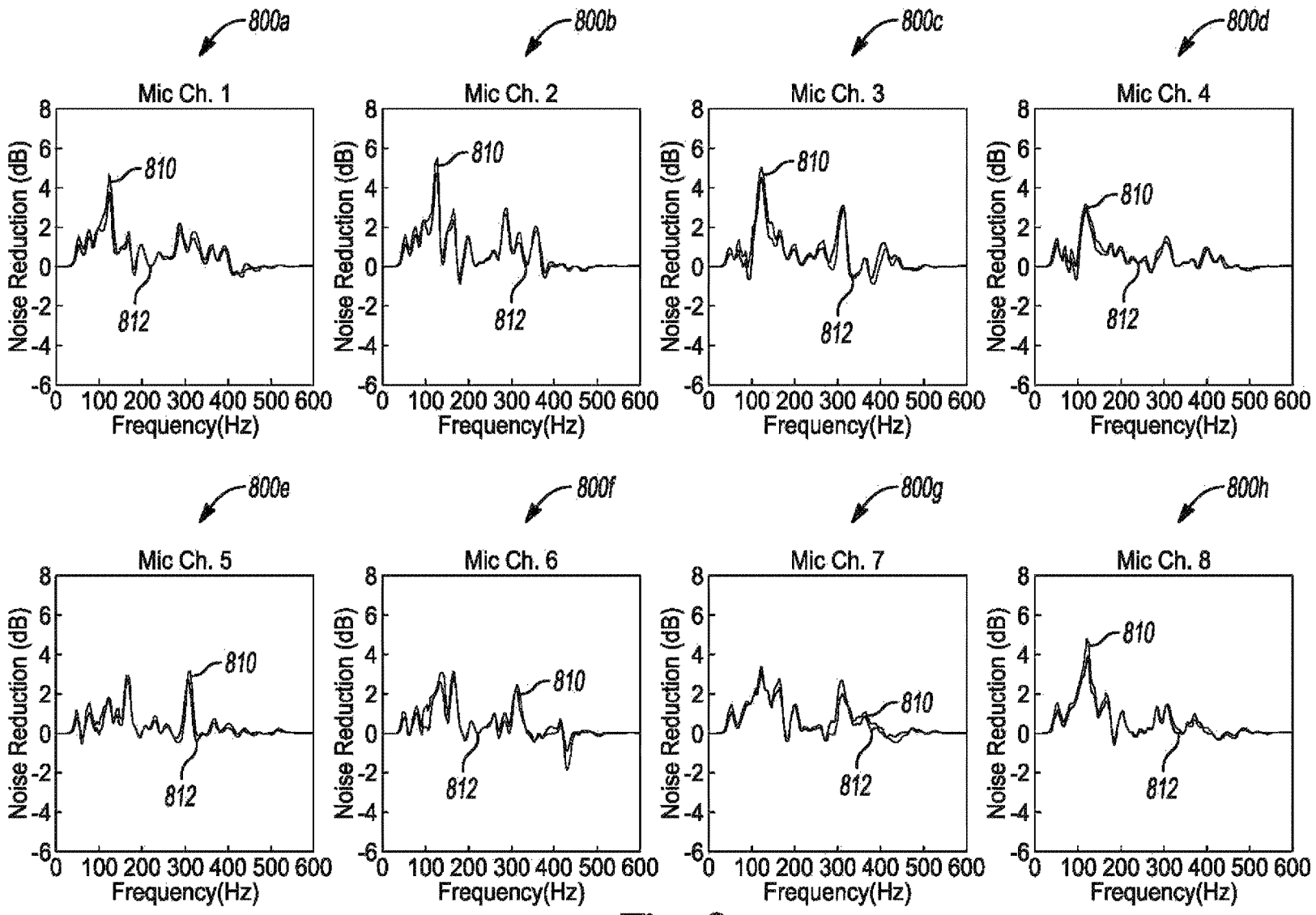
FIG. 9 depicts various plots corresponding to a normal road input that exhibit overall performance of the system of FIG. 1 and the current limiter of FIG. 3.

FIG. 9 depicts plots 800*a*-800*h* based on aspects of the current limiter 102 perform the method 500 of FIG. 5 in accordance with one embodiment. The plots 800*a*-800*h* depicts a noise reduction in a time period that ranges from 36 seconds to 51 seconds for normal road input case. Each plot 800*a*-800*h* includes a first waveform 810 and a second waveform 812. The first waveform 810 generally corresponds to an output provided by the current limiter 102 in which equalization is not performed (e.g., there is no attack leakage or release leakage being applied). The second waveform 812 generally corresponds to an output provided by the current limiter 102 that implements the method 500 of FIG. 4. As shown, the first waveform 810 and second waveform 812 generally exhibits similar performance on a normal road surface and that the second waveform 812 which incorporates the current limiter 102 that executes the method 500 of FIG. 5 does not adversely affect or limit RNC system performance while the vehicle 112 drives on a normal road surface.

Figure 10:
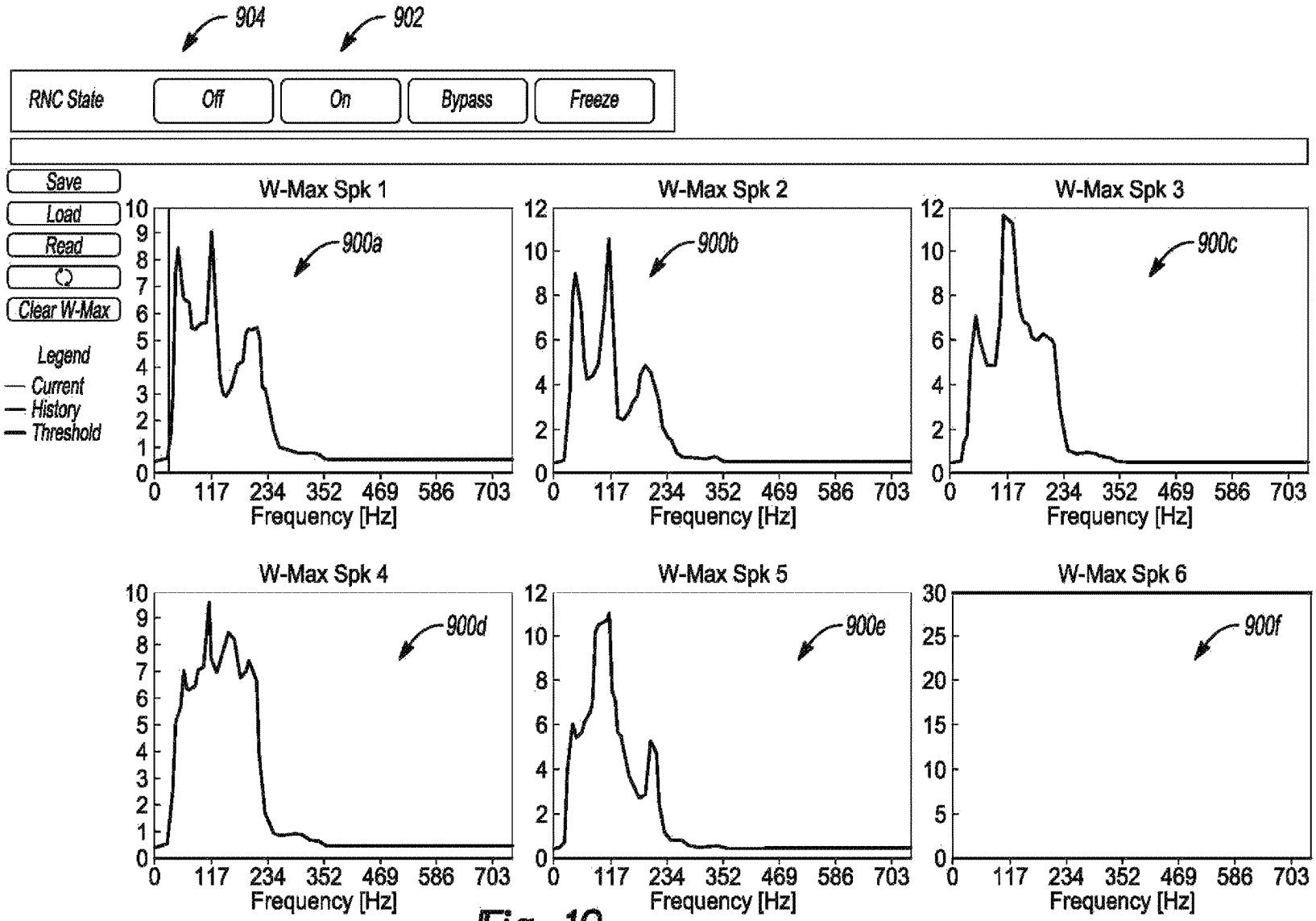
FIG. 10 depicts various plots corresponding to equalization aspects for the system of FIG. 1 and the current limiter of FIG. 3.

FIG. 10 depicts various plots 900*a*-900*e* corresponding to equalization aspects for the system of FIG. 1 and the current limiter of FIG. 3. Each of the plots 900*a*-900*e* generally illustrate $X_{THR}$ as defined in a frequency domain for each accelerometer signal (e.g., each reference signal). FIG. 10 also illustrates various switches generally shown at 902 which are formed on a graphical user interface (GUI) 904 to enable a technical to establish tuning parameters (e.g., define $X_{THR}$).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for providing a frequency dependent dynamic leakage for noise cancellation, the system comprising:

a noise cancellation controller programmed to perform noise cancellation in a vehicle based on a limited input signal; and a current limiter programmed to:

receive a reference signal from one of an accelerometer or a loudspeaker;

convert the reference signal from a time domain and into a frequency domain to limit the reference signal;

generate the limited input signal in response to limiting the reference signal; and modify the reference signal based on a gain constant and a limiter leakage constant, wherein the current limiter is further programmed to modify the reference signal based on the gain constant and the limiter leakage constant prior to converting the reference signal from the time domain into the frequency domain.

2. The system of claim 1, wherein the current limiter is further programmed apply an amount of leakage gain to the reference signal in response to comparing the modified reference signal in the frequency domain to a threshold reference gain.

3. The system of claim 2, wherein the current limiter is further programmed to apply an attack leakage to the reference signal to increase a rate at which the current limiter limits the reference signal to generate the limited input signal in response to the modified reference signal being greater than the threshold reference gain.

4. The system of claim 3, wherein the current limiter is further programmed to apply a release leakage to the reference signal to decrease the rate at which the current limiter limits the reference signal to generate the limited input signal in response to the modified reference signal being less than the threshold reference gain, wherein the rate at which the current limiter limits the reference signal when the release leakage is applied is less than the rate at which the current limiter limits the reference signal when the attack leakage is applied.

5. The system of claim 4, wherein the current limiter is further programmed to compare the limiter leakage constant to a predetermined constant prior to applying the release leakage to the reference signal in response to the modified reference signal being less than the threshold reference gain.

6. The system of claim 5, wherein the current limiter is further programmed to apply the release leakage to the reference signal in response to the limiter leakage constant being less than the predetermined constant.

7. The system of claim 1, wherein the noise cancellation controller is further programmed to perform one of active noise cancellation or road noise cancellation in the vehicle based on the limited input signal.

8. The system of claim 1, wherein the gain constant corresponds to a predetermined number of constants for each accelerometer that generates the reference signal.

9. The system of claim 1, wherein the current limiter is further programmed to modify the reference signal based on the gain constant and the limiter leakage constant by multiplying the reference signal to the gain constant and the limiter leakage constant.

10. A method for providing a frequency dependent dynamic leakage for noise cancellation, the method comprising:

performing noise cancellation in a vehicle, via a noise cancellation controller, based on a limited input signal;

receiving, at a current limiter, a reference signal from one of an accelerometer or a loudspeaker;

converting the reference signal from a time domain and into a frequency domain to limit the reference signal;

generating the limited input signal in response to limiting the reference signal; and modifying the reference signal based on a gain constant and a limiter leakage constant wherein modifying the reference signal based on the gain constant and the limiter leakage constant is performed prior to converting the reference signal from the time domain into the frequency domain.

11. The method of claim 10 further comprising applying an amount of leakage gain to the reference signal in response to comparing the modified reference signal in the frequency domain to a threshold reference gain.

12. The method of claim 11 further comprising applying an attack leakage to the reference signal to increase a rate at which the current limiter limits the reference signal to generate the limited input signal in response to the modified reference signal being greater than the threshold reference gain.

13. The method of claim 12 further comprising applying a release leakage to the reference signal to decrease the rate at which the current limiter limits the reference signal to generate the limited input signal in response to the modified reference signal being less than the threshold reference gain, wherein the rate at which the current limiter limits the reference signal when the release leakage is applied is less than the rate at which the current limiter limits the reference signal when the attack leakage is applied.

14. The method of claim 13 further comprising comparing the limiter leakage constant to a predetermined constant prior to applying the release leakage to the reference signal in response to the modified reference signal being less than the threshold reference gain.

15. The method of claim 14 further comprising applying the release leakage to the reference signal in response to the limiter leakage constant being less than the predetermined constant.

16. The method of claim 10 further comprising performing one of active noise cancellation or road noise cancellation in the vehicle based on the limited input signal.

17. The method of claim 10, wherein the gain constant corresponds to a predetermined number of constants for each accelerometer that generates the reference signal.

18. The method of claim 10, wherein modifying the reference signal based on a gain constant and a limiter leakage constant includes multiplying the reference signal to the gain constant and the limiter leakage constant.

19. A computer-program product embodied in a non-transitory computer read-able medium that is programmed for providing a frequency dependent dynamic leakage for noise cancellation, the computer-program product comprising instructions and being executable by one or more processors to;

perform noise cancellation in a vehicle, via a noise cancellation controller, based on a limited input signal;

receive, at a current limiter, a reference signal from one of an accelerometer or a loudspeaker;

convert the reference signal from a time domain and into a frequency domain to limit the reference signal;

generate the limited input signal in response to limiting the reference signal;

modify the reference signal based on a gain constant and a limiter leakage constant, and wherein modifying the reference signal based on the gain constant and the limiter leakage constant is performed prior to converting the reference signal from the time domain into the frequency domain.

20. The computer-program product of claim 19 further comprising instructions executable by the one or more processors to modify the reference signal based on a gain constant and a limiter leakage constant prior to converting the reference signal from a time domain and into a frequency domain to limit the reference signal.

* * * * *